US011203916B2

(12) United States Patent
Reid

(10) Patent No.: US 11,203,916 B2
(45) Date of Patent: Dec. 21, 2021

(54) MULTI-BALL VALVE ASSEMBLY

(71) Applicant: Halliburton Energy Services, Inc., Houston, TX (US)

(72) Inventor: Michael Adam Reid, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 165 days.

(21) Appl. No.: 16/599,593

(22) Filed: Oct. 11, 2019

(65) Prior Publication Data

US 2021/0108486 A1 Apr. 15, 2021

(51) Int. Cl.
*E21B 34/10* (2006.01)

(52) U.S. Cl.
CPC ..... *E21B 34/101* (2013.01); *E21B 2200/04* (2020.05)

(58) Field of Classification Search
CPC .... E21B 33/00; E21B 34/101; E21B 2200/04; E21B 34/08
See application file for complete search history.

(56) References Cited

U.S. PATENT DOCUMENTS 3,543,793 A 12/1970 Dollison
4,220,176 A 9/1980 Russell
4,576,234 A 3/1986 Upchurch
5,806,563 A 9/1998 Rabby
5,890,698 A * 4/1999 Domytrak ..... E21B 34/101 251/1.1
6,250,383 B1 * 6/2001 Patel ..... E21B 21/10 166/70
9,045,962 B2 * 6/2015 Christie ..... E21B 34/08

FOREIGN PATENT DOCUMENTS

CA 1187784 5/1985
WO 2006024860 A1 3/2006
WO 2016182599 A1 11/2016

* cited by examiner

*Primary Examiner* — Aaron L Lembo
(74) *Attorney, Agent, or Firm* — Scott Richardson; Parker Justiss, P.C.

(57) ABSTRACT

This disclosure provides a multi-ball valve assembly that lessens the pressure applied from either uphole or downhole directions by directing a portion of the pressure into a sealed fluid chamber area between two balls that are operatively coupled together by one or more control arms. The multi-ball valve assembly may be a floating design where the balls move axially with respect to each other or fixed designs that use either pressure relief valves or biased travel piston valves to divert a portion of the pressure into the fluid chamber area, thereby lessening the distortion of the face of the ball valve against which fluid pressure is being applied.

12 Claims, 9 Drawing Sheets

MULTI-BALL VALVE ASSEMBLY

BACKGROUND

Operations performed and equipment utilized in conjunction with a subterranean production well often require one or more different types of valves. One such valve is a ball valve. A ball valve is a type of valve that uses a spherical ball valve member as a closure mechanism. The ball valve member has a hole there through that is aligned with the direction of flow when the valve is opened and misaligned with the direction of flow when the valve is closed.

Ball valves have many applications in well tools for use downhole in a wellbore, for example, as formation tester valves, safety valves, and in other downhole applications. Many of these well tool applications use a ball valve because their ball valve members can have a large through bore for passage of tools, tubing strings, and flow, yet may also be compactly arranged. For example, ball valves may have a cylindrical inner profile that corresponds to the cylindrical inner profile of the remainder of the tools that it associates with. During operations, the ball valve is subjected to extreme pressures, and as a result of these pressures, the exposed surface of the ball valve can become distorted.

BRIEF DESCRIPTION

Reference is now made to the following descriptions taken in conjunction with the accompanying drawings, in which.

DETAILED DESCRIPTION

Figure 1:
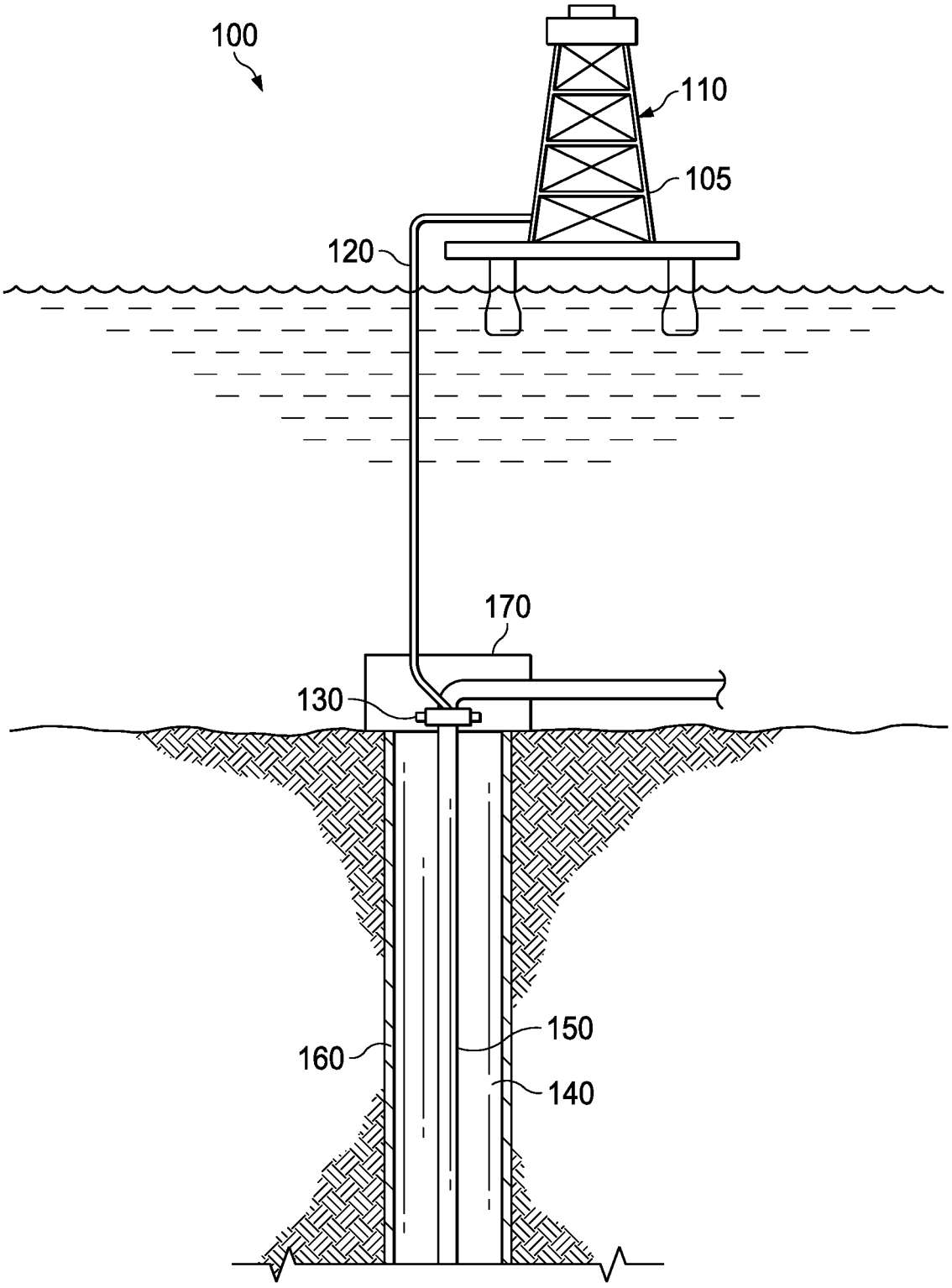
FIG. 1 illustrates a well system in which a multi-ball valve assembly of the present disclosure may be employed.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "above," "up," "upper," "upward," "uphole," "upstream," or other like terms, including their use in the claims, shall be construed as generally toward the well surface; likewise, use of the terms "below," "down," "lower," "downward," "downhole," or other like terms shall be construed as generally toward the bottom, terminal end of a well, regardless of the wellbore orientation. Use of any one or more of the foregoing terms is meant to be used to provide a general orientation or arrangement of the components within the device and with respect to each other and shall not be construed to require the device to be located in a well bore or to denote positions along a perfectly vertical or horizontal axis. Unless otherwise specified, use of the term "subterranean formation" shall be construed as encompassing both areas below exposed earth and areas below earth covered by water, such as ocean or fresh water. Further, any references to "first," "second," etc. do not specify a preferred order of method or importance, unless otherwise specifically stated, but such terms are for identification purposes only and are intended to distinguish one element from another. For example, a first element could be termed a second element, and, similarly, a second element could be termed a first element, without departing from the scope of the embodiments of this disclosure. Moreover, a first element and second element may be implemented by a single element able to provide the necessary functionality of separate first and second elements.

Ball valve assemblies are currently used in the oil and gas industry and often utilize a metal to metal (m-t-m) seal to ball sealing arrangement. A seating member is biased towards the ball by means of a spring that is typically located above, or uphole, of a sealed boost piston, but the spring force is often insufficient alone to generate enough contact stress to maintain a gas tight seal over a range of pressures. Higher differential pressures require higher contact stresses to maintain a seal. Therefore, it is usual to incorporate a sealed boost piston that has upper and lower seals sized to be above and below the m-t-m seal point. This arrangement has the effect of causing the seating member to be pushed onto the ball with the applied wellbore pressure regardless of which direction the wellbore pressure is applied (above the ball or below). Though this arrangement works well and gives an increasing contact pressure, as the differential pressure increases it is subject to the loss of seal integrity, because depending on the direction of the applied pressure differential, the ball itself can be subjected to considerable loading, particularly when the pressure is applied from below (when the seat is located below the ball). In such instances, the large surface area within the m-t-m seal diameter is exposed to higher pressures, causing the ball to distort, resulting in a loss of seal integrity of the m-t-m seal.

The present disclosure recognizes that it is advantageous to reduce the amount of pressure exerted against the surface of a sealing ball valve member and reduce the amount of distortion that a sealing ball valve member may undergo during downhole high pressure situations. To achieve this, the embodiments of this disclosure provide a multi-ball valve assembly that lessens the pressure applied from either uphole or downhole directions by directing a portion of the pressure into a sealed fluid chamber area between the ball valve members. The disclosed embodiments utilize two or more stacked ball valve members that are operatively coupled together but are independently biased away from each other, allowing one or both to move towards one another under pressure. For example, pressure from below will move the lower ball valve member upward towards the uppermost ball valve member, and in a reverse pressure situation, pressure from above will move the upper ball valve member lower and towards the downhole positioned ball valve member. When both ball valve members are in a closed position, a closed volume of fluid is trapped between the ball valve members. If for instance, pressure is applied to the lower ball valve member from below, the lower ball valve member will attempt to move upward by its limited amount and compresses the fluid trapped in the closed volume. By limiting the travel of the lower ball valve member, this trapped pressure can be limited to be approximately half the applied pressure, thus halving the differential pressure across the lower ball valve member. The upper ball valve member will only see the differential pressure between what's trapped below it and the hydrostatic above. This way the stress on both ball valve members can be significantly reduced allowing for a greater chance of a seal between the ball valve member and the seating member.

In one embodiment, the ball valve members are fixed and the embodiment includes two pressure relief valves set at desired pressures, one allowing fluid to bypass the upper ball valve member to communicate with the void between the ball valve members and a lower pressure relief valve performing a similar action from below. When the ball valve members are shut, the effect is the same, that is, the differential across each ball valve member is greatly reduced.

Another embodiment includes ball valve members that are fixed axially and have two limited travel piston valves to increase pressure between the closed ball valve members. By using the ball valve assembly of this disclosure, either an uphole pressure or a downhole pressure can be stepped down multiple ball valve members located within the same ball housing, reducing the resultant differentials across each ball valve member and minimizing the deflection of the ball valve members' surface, thereby, improving the changes of a zero leak seal.

Referring to FIG. 1, depicted is a well system 100 including an exemplary operating environment in which the apparatuses, systems and methods disclosed herein may be employed. The well system 100, in the embodiment shown in FIG. 1, includes a rig 105 (e.g., intervention or servicing rig) located on an offshore platform 110. A multi-ball valve assembly 130, such as those provided by the embodiments of this disclosure, is operatively connected to the offshore platform 110 via fluid/electrical connection 120. By way of convention in the following discussion, though FIG. 1 depicts a vertical wellbore, it should be understood by those skilled in the art that embodiments of the apparatus according to the present disclosure are equally well suited for use in wellbores having other orientations including horizontal wellbores, slanted wellbores, multilateral wellbores or the like. While the fluid/electrical connection 120 may include one or both of a fluid connection and/or electrical connection, in many embodiments consistent with the disclosure, the fluid/electrical connection 120 provides only a fluid connection (e.g., a hydraulic open line and a hydraulic closed line). An annulus 140 may be defined between walls of well 160 and a seal conduit 150. Wellhead 170 may provide a means to hang off and seal conduit 150 against well 160 and provide a profile to latch a subsea blowout preventer to. Seal conduit 150 may be coupled to wellhead 170. Seal conduit 150 may be any conduit such as a casing, liner, production tubing, or other tubulars disposed in a wellbore. Although the well system 100 is depicted in FIG. 1 as an offshore well, one of ordinary skill should be able to adopt the teachings herein to any type of well including onshore or offshore.

The fluid/electrical connection 120 may extend into the well 160 and may be connected to the multi-ball valve assembly 130. The fluid/electrical connection 120 may provide actuation and/or de-actuation of the multi-ball valve assembly 130. Actuation may comprise opening the multi-ball valve assembly 130 to provide a flow path for wellbore fluids to exit the well 160, and de-actuation may comprise closing the multi-ball valve assembly 130 to close a flow path for wellbore fluids to exit the well 160.

The multi-ball valve assembly 130 may be interconnected to conduit 150. In one embodiment, the multi-ball valve assembly 130 is located above the well 160, as is shown in FIG. 1. In other embodiments, the multi-ball valve assembly 130 may be positioned in the well 160. As described in more detail below, the multi-ball valve assembly 130, in accordance with the principles of the disclosure, includes a valve body having a ball housing with a central bore. The ball housing is coupled to a ball housing sub-assembly, which form the outer surface of the valve assembly. The ball valve members have a bore there through and are located in the ball housing for selective rotation between valve open and valve closed positions to control flow through the valve assembly. A seating member is slidably coupled to the valve body adjacent the central bore and has a metal seat located on a seating end thereof that is engagable against the ball valve member.

Figure 2A:
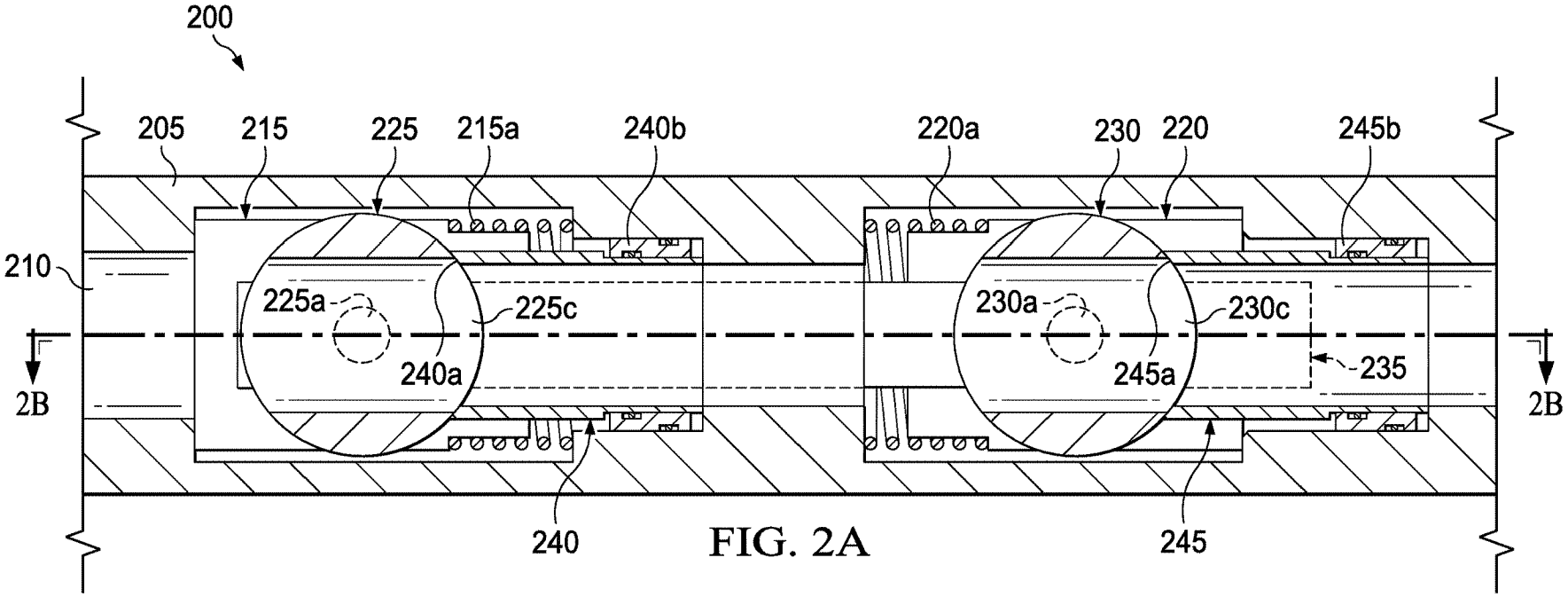
FIGS. 2A-2C are sectional views of one embodiment of a multi-ball valve assembly of the present disclosure.
Figure 2B:
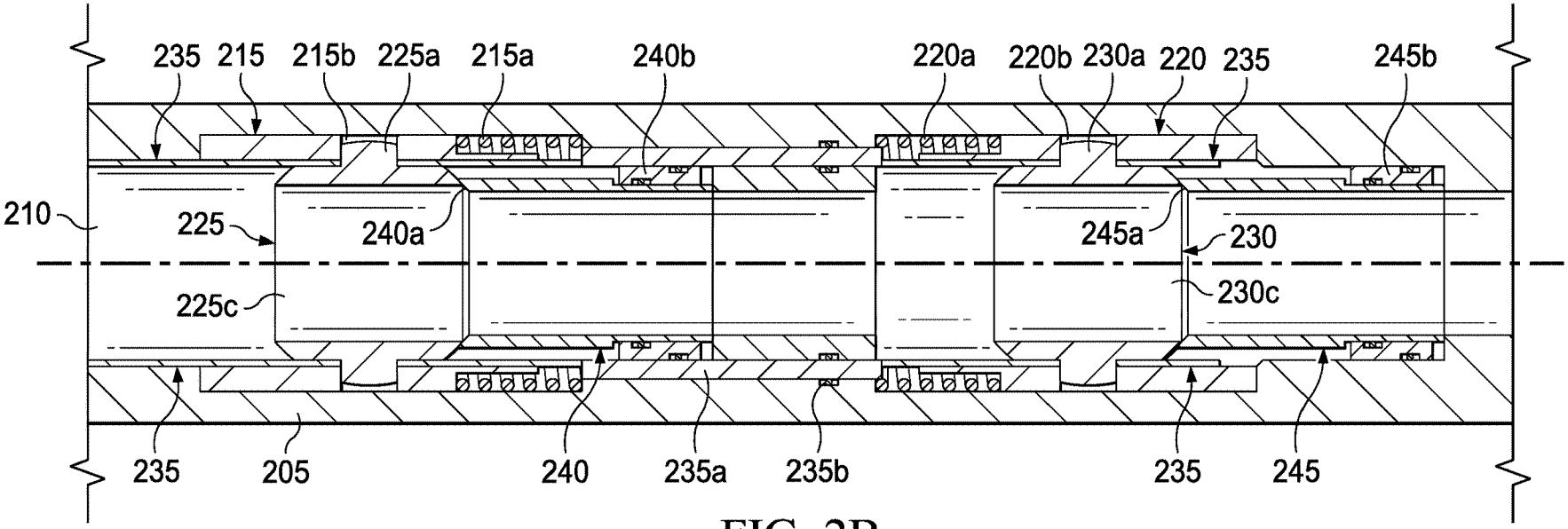
Figure 2C:
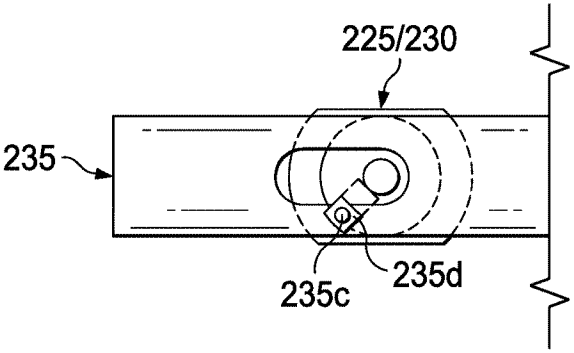

Turning to FIGS. 2A-2C, illustrated are sectional views of one embodiment of a multi-ball valve assembly 200 provided by the present disclosure. In this embodiment, the multi-ball valve assembly 200 comprises a ball housing 205 that can be coupled to a well sub-assembly (not shown). In the illustrated embodiments, the ball housing 205 is shown to be a unitary or singular piece, however, it should be understood that, as used herein and in the claims, the ball housing 205 includes embodiments where the ball housing 205 are separate housings that are coupled together to function as a unitary ball housing. The ball housing 205 has a central bore 210 that extends through it and through which fluid can flow. First and second ball cages 215, 220 are respectively and slidably located within a cavity formed in an interior diameter wall of the ball housing 205, as generally illustrated in the embodiments of FIGS. 2A and 2B. The first ball cage 215 may be biased upwardly or uphole by a biasing element 215*a*, such as a spring, and the second ball cage 220 may be biased downwardly or downhole by a biasing element 220*a*. First and second ball valve members 225, 230 are rotatably captured within the first and second ball cages 215 and 220, respectively, by ball slots 215*b*, 220*b*, as shown in FIG. 2B. The ball slots 215*b*, 220*b* are dimensioned to receive a rotation pin 225*a*, 230*a* of each of the first and second ball valve members 225, 230. It should be noted that while only first and second ball valve members 225, 230 are shown, other embodiments may provide more than two ball valve members with like configuration and design. Each of the first and second ball valve members 225, 230 have a bore 225*c*, 230*c* there through that allows fluid to flow either uphole or downhole when the first and second ball valve members 225, 230 are in their respective open positions.

The multi-ball valve assembly 200 further includes one or more control arm(s) 235. In certain embodiments, the control arm(s) 235 includes a piston rod 235*a* that connects two separate portions of the control arm(s) 235 together and an isolation seal 235*b*. The illustrated embodiments show a control arm(s) 235 on each side of the first and second ball valve members 225, 230, however, other embodiments may have only one control arm. The control arm(s) 235 are coupled to and actionable on the first and second ball valve members 225, 230 to rotate them to open or closed positions. In one embodiment, the control arm(s) 235 are coupled to the first and second ball valve members 225, 230 by a control arm pin 235*c* and cam washer 235*d* in the ball slots 215*b*, 220*b*.

The embodiments of the multi-ball valve assembly 200 further comprise a first seating member 240 located between the first and second ball valve members 225, 230 and being slidably coupled to the ball housing 205 within the central bore 210. The first seating member 240 has a metal seat 240*a* located on a seating end thereof that is engagable against the first ball valve member 225 that forms a m-t-m seal. The second seating member 245 that is located downhole from the second ball valve member 230, has a metal seat 245*a* located on a seating end thereof that is engagable against the second ball valve member 230 that also forms a m-t-m seal. The first and second seating members 240, 245 are slideably captured within the central bore 210. In the illustrated embodiments, the first and second seating members 240, 245 are cylindrical, hollow tubes that have diameters that are exposed to the central bore 210 and through which well fluids can flow. Sealed boost pistons 240*b* and 245*b* may also be present that drive the first and second seating members 240, 245 against the first and second ball valve members 225, 230. When pressures are applied against the valve assembly 200, the first and second seating members 240, 245 are pushed toward the first and second ball valve members 225, 230, by the sealed boost pistons 240*b* and 245*b* that cause the metal seats 240*a*, 245*a* to engage their respective first and second ball valve members 225, 230. The metal seats 240*a*, 245*a* may be of known design, which are typically machined as a shoulder area on the end of the first and second seating members 240, 245.

Figure 3:
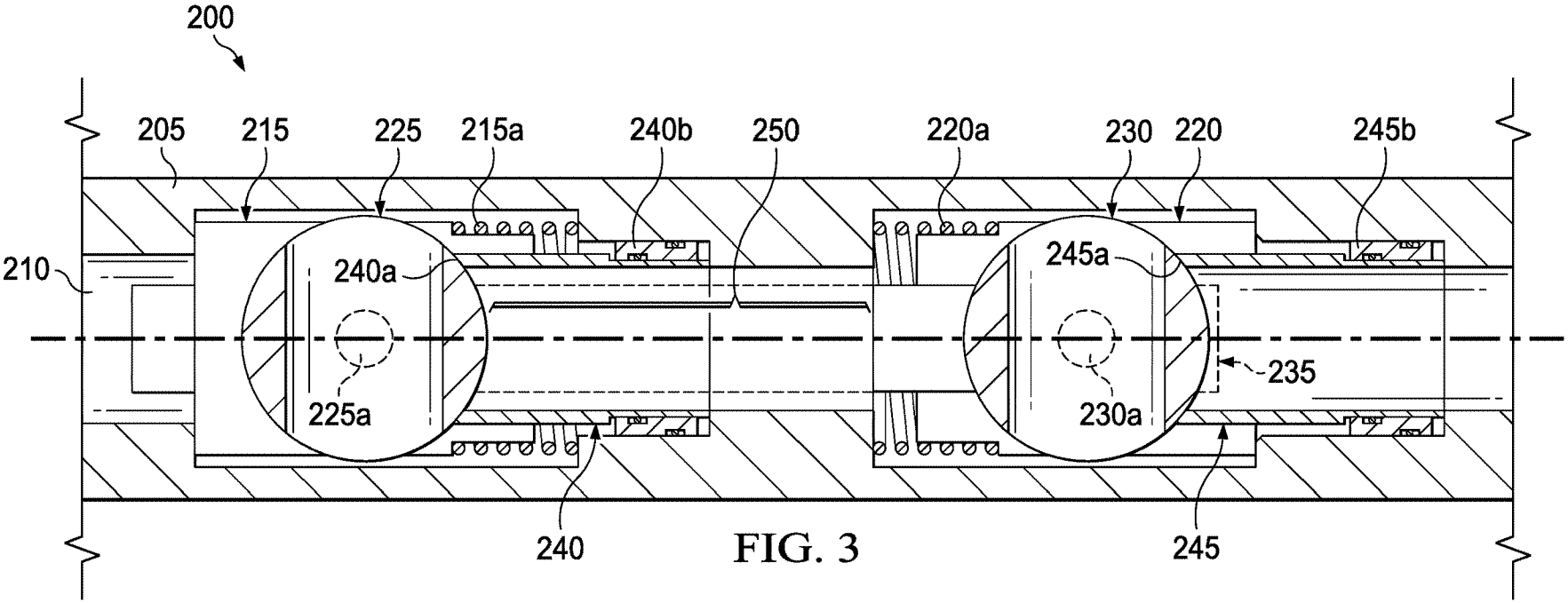
FIG. 3 is a sectional view of the embodiment of FIGS. 2A-2C in which the ball valve members are closed and prior to application of pressure.

FIG. 3 illustrates the multi-ball valve assembly 200 after the control arm(s) 235 has been manipulated to move the first and second ball valve members 225, 230 to a closed position. The closing action of the first and second ball valve members 225, 230 forms a fluid chamber area 250 between the first and second ball valve members 225, 230. While in the open position, well bore fluid is allowed to flow into the fluid chamber area 250. Upon being moved to the closed positions, the first and second ball valve members 225, 230 trap the well bore fluid in the fluid chamber area 250. As explained below, this trapped fluid can then be used to reduce the pressure differential across the first and second ball valve members 225, 230 when pressure is applied against either of the first and second ball valve members 225, 230 from either an uphole or downhole direction. At this point, however, pressure has not been applied against either the first or second ball valve members 225, 230, so neither of the biasing members 215*a* and 220*a* are compressed.

Figure 4:
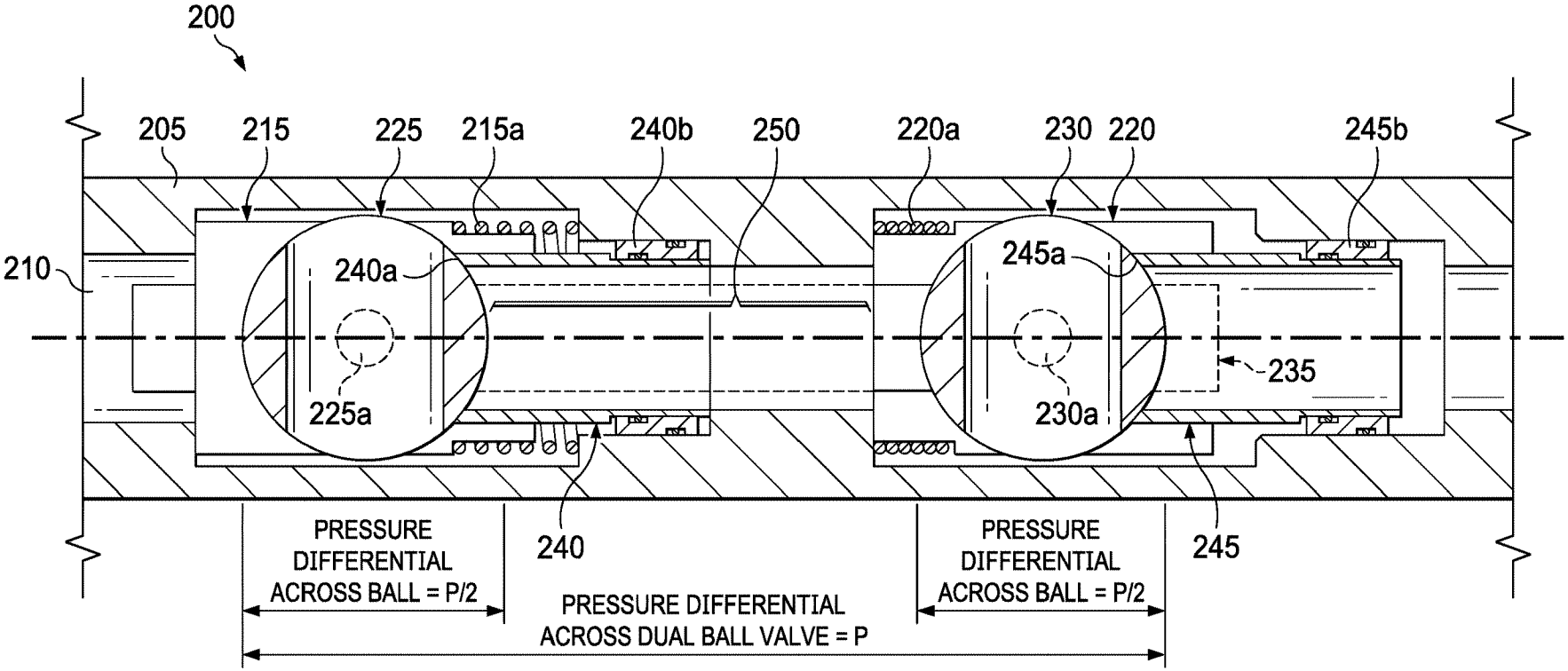
FIG. 4 is a sectional view of the embodiment of FIG. 3 in which pressure from downhole is being applied one of the ball valve members.

FIG. 4 illustrates the embodiment of FIG. 3 where pressure from downhole is exerted against the downhole face (shown in cross hatching) of the second ball valve 230, as it is in a closed position. The pressure acts on the sealed boost piston 245*b*, which drives the seating member 245 against the second ball valve 230 and pushes the second ball cage 220 and second ball valve 230 uphole, which compresses the biasing member 220*a*, as generally shown. The biasing force of the biasing member 220*a* may be designed to provide the appropriate biasing resistance so that the appropriate amount of pressure force is transmitted to the fluid in the fluid chamber area 250. As the second ball valve 230 is pushed uphole, the trapped volume of fluid contained within the fluid chamber area 250 is compressed or squeezed by a predetermined amount, causing the pressure to rise in the trapped volume. If the travel of the second ball valve 230 is limited by the counter force of the biasing member 220*a*, the trapped pressure can be limited to be below the applied pressure, ideally P/2 (where P is the pressure differential across the first and second ball valve members 225 and 230). This will then reduce the pressure differential across each of the first and second ball valve members 225, 230, which, in turn, will reduce the stress on each of the first and second ball valve members 225, 230. As a result, the deflection of the downhole face of the second ball valve 230 is reduced, leading to a tighter seal between the second ball valve member 230 and the second seating member 245, as shown in FIG. 4. It should be understood that this same pressure transfer occurs if the pressure is applied from uphole against the first ball valve member 225.

Figure 5A:
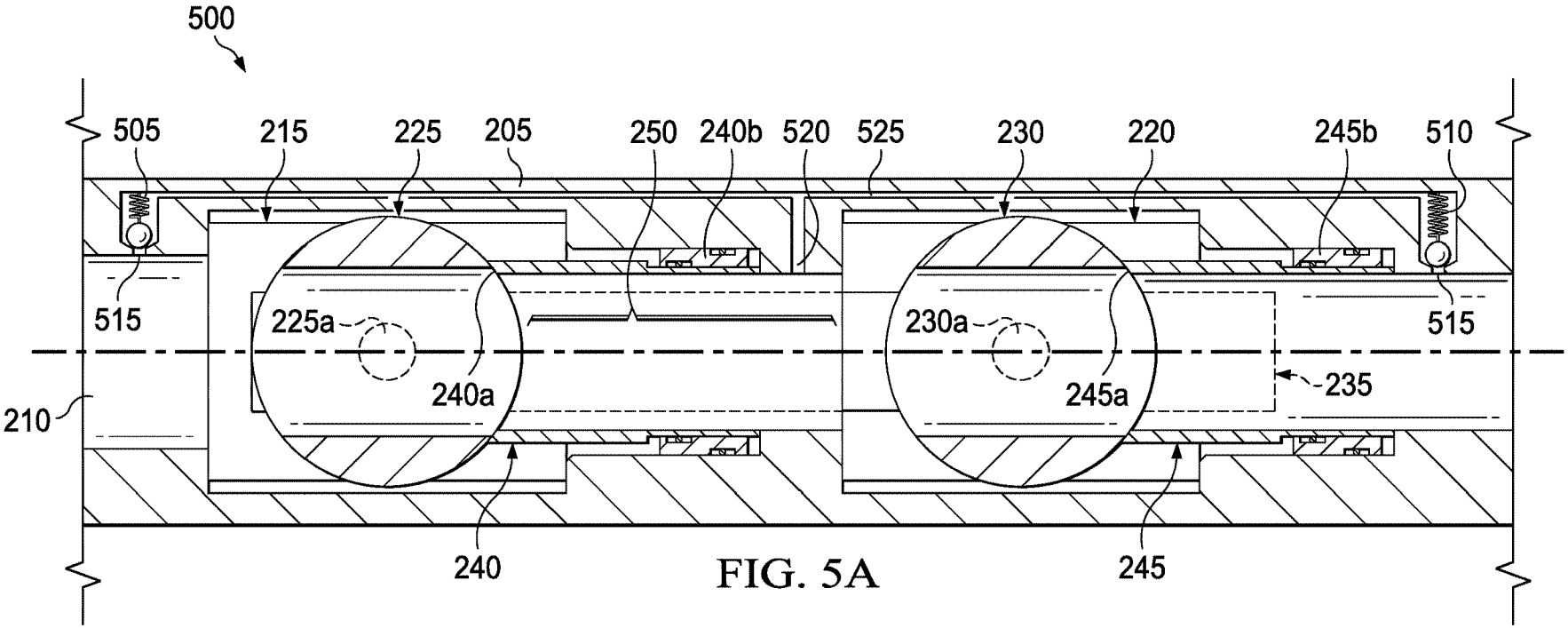
FIGS. 5A-5B are sectional views of another embodiment of the multi-ball valve assembly that uses one or more pressure relief valves to divert a portion of pressure.
Figure 5B:
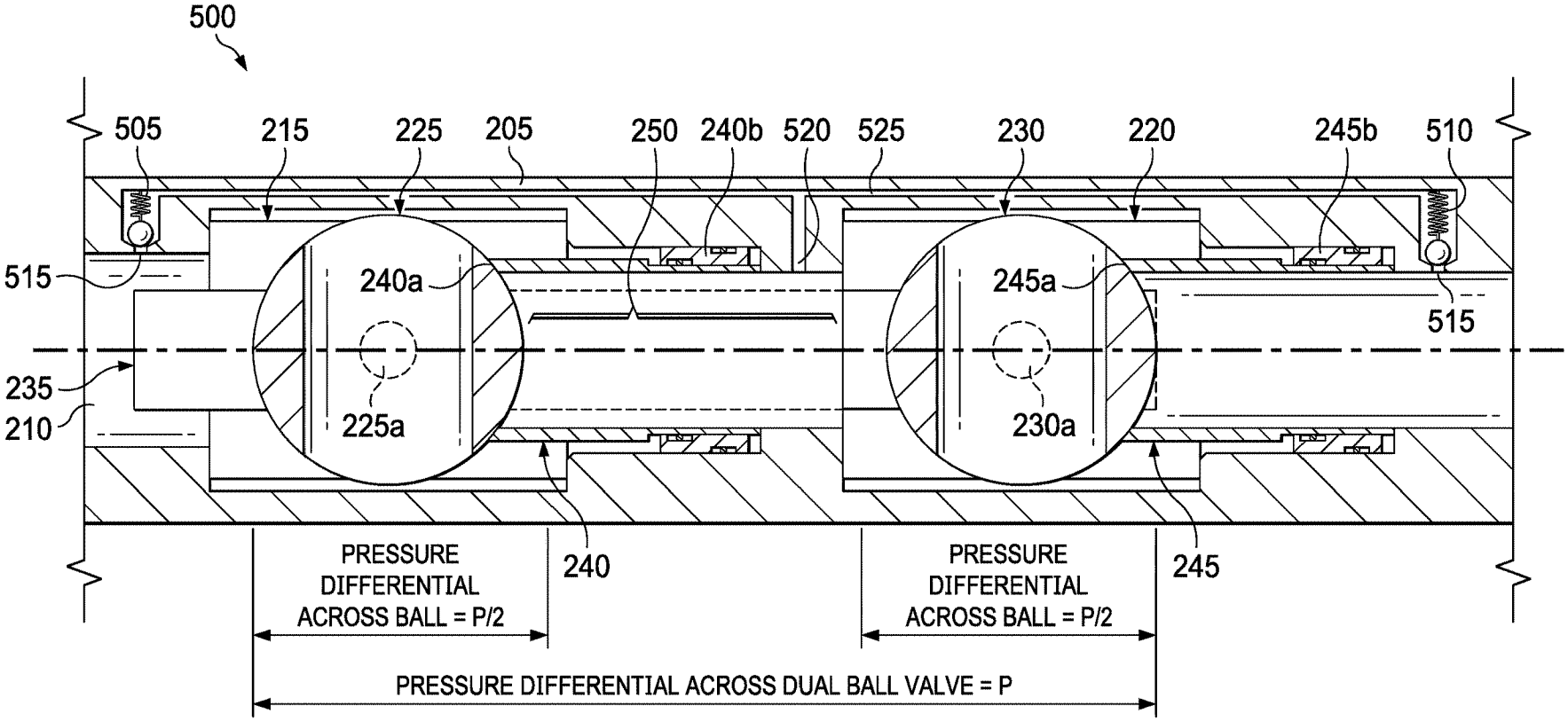

FIGS. 5A and 5B illustrate another embodiment of the multi-ball valve assembly 500. This embodiment, the first and second ball valve members 225, 230 are axially fixed with respect to each other and the pressure differential transfer occurs by way of one or more pressure relief valves 505, 510 located within cavities formed in an interior wall of the ball housing 205, in place of the biasing members, as in the previous embodiments. Pressure relief valve 505 is associated with the first ball valve member 225 in that it may be used when a pressure from uphole is exerted against the first ball valve member 225 and pressure relief valve 510 is associated with the second ball valve member 230 and may be used in those instances when a pressure from downhole is exerted against the second ball valve member 230. Though two pressure relief valves are present in the illustrated embodiment, it should be understood that only one pressure relief valve may be used. For example, in downhole applications where the pressure is expected to always come from downhole, only pressure relief valve 510 may be present. The pressure relief valve can be set at a desired pressure to divert a portion of the pressure exerted against the first or second ball valve members 225, 230. In those embodiments where first and second pressure relief valves 505, 510 are present, the uphole or first pressure relief valve 505 can be set to allow fluid to bypass the first ball valve member 225 to communicate with the fluid chamber area 250 and the downhole or second pressure relief valve 510 can be set to allow fluid to bypass the second ball valve member 230. The embodiments of FIGS. 5A and 5B further comprise pressure communication ports 515 located in the ball housing 205 that fluidly connect the pressure relief valve 505 or 510 with the central bore and a fluid port 520 by way of a fluid path 525. As illustrated, the fluid port 520 has a first end that opens into the fluid chamber area 250 of the ball housing 205 and a second end that opens into the fluid path 525 that extends from the fluid port 520 to the pressure relief valve 505, 510. In those embodiments where both pressure relief valves 505, 510 are present, the fluid path 525 extends from the fluid port 520 to the first and second pressure relief valves 505, 510, as generally shown.

FIG. 5A illustrates the first and second ball valve members 225, 230 in an open position, which allows fluid to fill the fluid chamber area 250, and FIG. 5B illustrates the first and second ball valve members 225, 230 after the control arm(s) 235 has manipulated them to a closed position. As pressure from downhole is exerted against the downhole face of the second ball valve 230, the pressure acts on the sealed boost piston 245*b*, which drives the seating member 245 against the second ball valve 230. Additionally, pressure enters the pressure communication port 515 and acts on the pressure relief valve 510. Per the pressure relief valve's 510 setting, a set amount of pressure is exerted against the fluid that is already present in the fluid path 525. The fluid in the fluid path 525 transfers that pressure to the fluid chamber area 250 by way of the fluid port 520. Ideally, the pressure relief valve 510 is set for the pressure to be below the applied pressure, ideally P/2 (where P is the pressure differential across the first and second ball valve members 225 and 230). This pressure transfer reduces the pressure differential across each of the first and second ball valve members 225, 230, which, in turn, reduces the stress on each of the first and second ball valve members 225, 230. As a result, the deflection of the downhole face of the second ball valve 230 is reduce, leading to a tighter seal between the second ball valve member 230 and the second seating member 245, as generally shown in FIG. 5B. It should be understood that this same pressure transfer can occur if the pressure is applied from uphole against the first ball valve member 225.

Figure 6A:
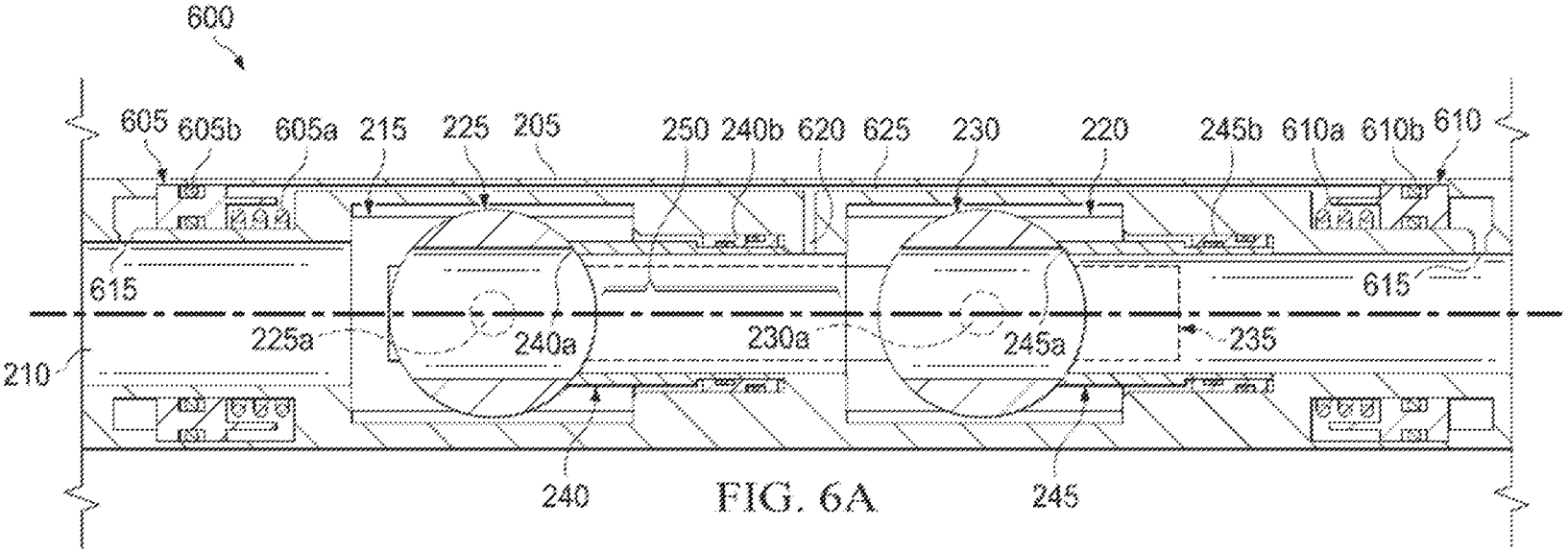
FIGS. 6A-6B are sectional views of another embodiment of the multi-ball valve assembly that uses one or more travel piston valves to divert a portion of the pressure.
Figure 6B:
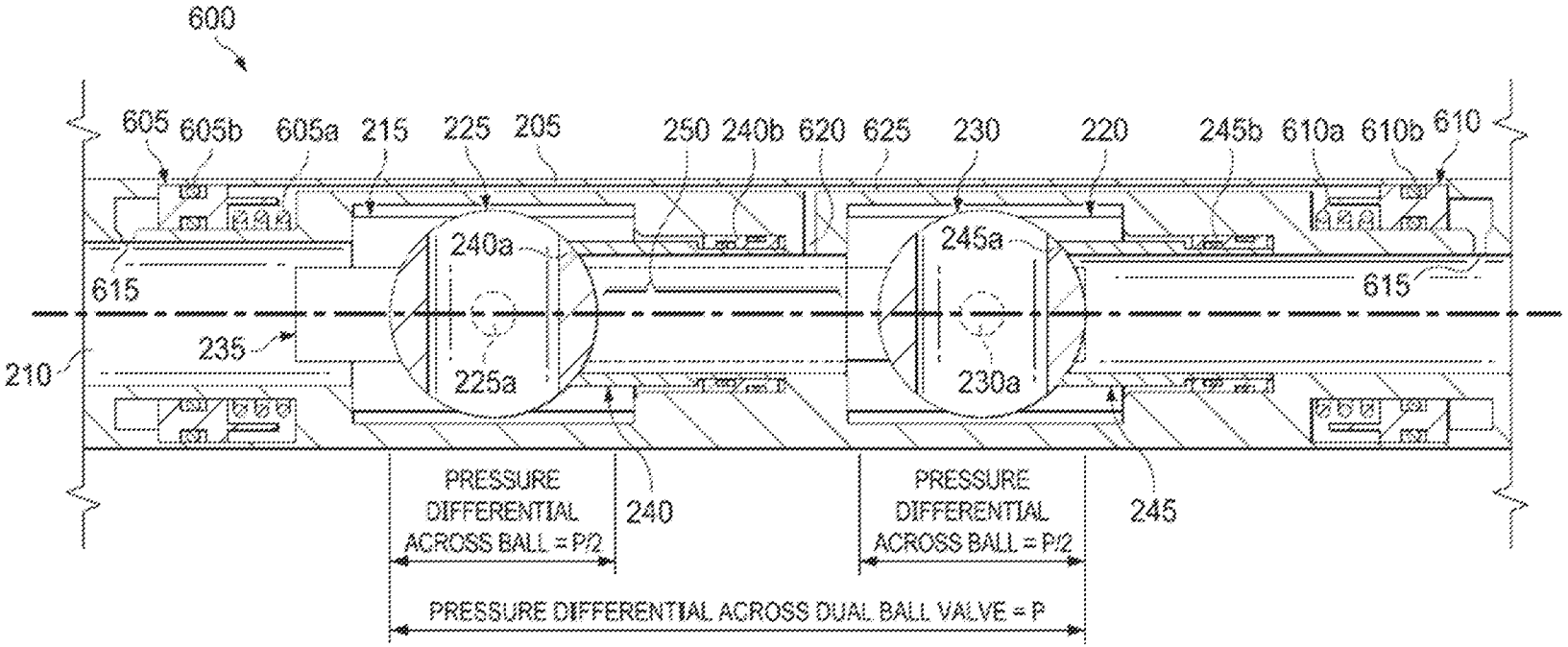

FIGS. 6A and 6B illustrate another embodiment of the multi-ball valve assembly 600. In this embodiment, the first and second ball valve members 225, 230 are axially fixed with respect to each other and the pressure differential transfer occurs by way of first or second travel piston valves 605, 610 located within cavities formed in an interior wall of the ball housing 205. The first and second travel piston valves 605, 610 include biasing member 605*a*, 610*a*, respectively. For example, the biasing members 605*a*, 610*a* may be a spring or other biasing material that is resistant to compression that are located within the travel piston valves' 605, 610 cavities. The biasing constant allows the biasing members 605*a*, 610*a* to be compressed when a predetermined pressure is exerted against the first or second travel piston valves 605 or 610. The first and second travel piston valves 605, 610 further include seals 605*b*, 610*b* that prevent fluid from flowing past the first and second travel piston valves 605 or 610. The first travel piston valve 605 is associated with the first ball valve member 225 in that it may be used when a pressure from uphole is exerted against the first ball valve member 225, and the second travel piston valve 610 is associated with the second ball valve member 230 and may be used in those instances when a pressure from downhole is exerted against the second ball valve member 230. Though first and second travel piston valves 605, 610 are present in the illustrated embodiments, it should be understood that only one travel piston valve may be used. For example, in downhole applications where the pressure is expected to always come from downhole, only the second travel piston valve 610 may be present. Biasing members 605*a*, 610*a* can be designed to allow their associated first or second travel piston valves 605, 610 to move in the direction of the pressure force when sufficient pressure is exerted against the first or second travel piston valves 605 or 610 and divert a portion of the pressure exerted against the first or second ball valve members 225, 230.

The embodiments of FIGS. 6A and 6B further comprise pressure communication ports 615 located in the ball housing 205 that fluidly connect the first or second travel piston valves 605, 610 with the central bore 210 and a fluid port 620 that has a first end that opens into the fluid chamber area 250 of the ball housing 205 and a second end that opens into a fluid path 625 that extends from the fluid port 620 to the first or second travel piston valves 605, 610. In those embodiments where both the first and second travel piston valves 605, 610 are present, the fluid path 625 extends from the fluid port 620 to the first and second travel piston valves 605, 610. Also, in those embodiments where the first and second travel piston valves 605, 610 are present, the biasing member 605*a* of the uphole or first travel piston valve 605 can be designed to allow the first travel piston valve 605 to move to compress a fluid in the fluid path 625, thereby transferring a portion of the pressure to the fluid chamber area 250. Similarly, the biasing member 610*a* of the downhole or second travel piston valve 610 can be designed to allow the second travel piston valve 610 to move to compress a fluid in the fluid path 625, thereby transferring a portion of the fluid chamber area 250.

FIG. 6A illustrates the first and second ball valve members 225, 230 in an open position, which allows fluid to fill the fluid chamber area 250, the fluid port 620, and the fluid path 625. FIG. 6B illustrates the first and second ball valve members 225, 230, after the control arm(s) 235 has manipulated them to a closed position. As pressure from downhole, for example, is exerted against the downhole face of the second ball valve 230, the pressure acts on the sealed boost piston 245*b*, which drives the seating member 245 against the second ball valve 230. Additionally, pressure enters the pressure communication port 615 and acts on the travel piston valve 610. Per the designed biasing constant of the biasing member 610*a*, the pressure overcomes the biasing member's 610*a* biasing constant and moves the second travel piston valve 610 uphole. As such, the second travel piston valve 610 compresses the fluid in the fluid path 625 and transfers a portion of the pressure to the fluid chamber area 250 by way of the fluid port 620. Ideally, the biasing member 610*a* is set for the pressure to be below the applied pressure, ideally P/2 (where P is the pressure differential across the first and second ball valve members 225 and 230). The transfer of pressure to the fluid chamber area 250 reduces the pressure differential across each of the first and second ball valve members 225, 230, which, in turn, reduce the stress on each of the first and second ball valve members 225, 230. As a result, the deflection of the downhole face of the second ball valve 230 is reduced, leading to a tighter seal between the second ball valve member 230 and the second seating member 245, as generally shown in FIG. 6B. It should be understood that this same pressure transfer occurs, if the pressure is applied from uphole against the first ball valve member 225.

The invention having been generally described, the following embodiments are given by way of illustration and are not intended to limit the specification of the claims in any manner/

Embodiments herein comprise:

A valve assembly, comprising: a valve body having a ball housing with a central bore there through; first and second ball cages each located within a cavity formed in an interior diameter wall of the ball housing; first and second ball valve members located within and rotatably coupled to the first and second ball cages, respectively, and each having a bore there through and located in the ball housing for selective rotation between open and closed positions to control flow through the valve assembly. The first and second ball valve members define a fluid chamber area located within the central bore and between the first and second ball valve members. A control arm is coupled to the first and second ball valve members and is actionable on the first and second ball valve members to rotate the first and second ball valve members to the open or closed positions. A first seating member is located between the first and second ball valve members and is slidably coupled to the valve body adjacent the central bore and has a metal seat located on a seating end thereof that is engagable against the first ball valve member. A second seating member is located downhole from the second ball valve member and is engagable against the second ball valve member and has a metal seat located on a seating end thereof that is engagable against the second ball valve member.

Another embodiment is directed to a well system. In this embodiment, the well system comprises a string of tubing extending into a wellbore that is connected to a valve assembly and being supported from a rig support structure. The valve assembly comprising a valve body having a ball housing with a central bore there through; first and second ball cages each located within a cavity formed in an interior diameter wall of the ball housing; first and second ball valve members located within and rotatably coupled to the first and second ball cages, respectively, and each having a bore there through and located in the ball housing for selective rotation between open and closed positions to control flow through the valve assembly. The first and second ball valve members define a fluid chamber area located within the central bore and between the first and second ball valve members. A control arm is coupled to the first and second ball valve members and is actionable on the first and second ball valve members to rotate the first and second ball valve members to the open or closed positions. A first seating member is located between the first and second ball valve members and is slidably coupled to the valve body adjacent the central bore and has a metal seat located on a seating end thereof that is engagable against the first ball valve member. A second seating member is located downhole from the second ball valve member and is engagable against the second ball valve member and has a metal seat located on a seating end thereof that is engagable against the second ball valve member.

Element 1: wherein the first and second ball cages are slidable within each cavity, and further comprising: a first biasing member located between a wall of the cavity in which the first ball cage is located and the first ball cage and engaged against the first ball cage; and a second biasing member located between a wall of the cavity in which the second ball cage is located and the second ball cage and engaged against the second ball cage.

Element 2: wherein the first and second ball cages are axially fixed with respect to each other and further comprising: a pressure relief valve located within an interior diameter wall of the ball housing and positioned uphole or downhole from the fluid chamber area; a pressure communication port located in the ball housing that fluidly connects the pressure relief valve with the central bore; and a fluid port that has a first end that opens into the fluid chamber area of the ball housing and a second end that opens into a fluid path that extends from the fluid port to the pressure relief valve.

Element 3: wherein the pressure relief valve is set to divert a portion of the pressure exerted against the first or second ball valve member when in a closed position to a fluid located within the fluid chamber area through the fluid port.

Element 4: wherein the pressure relief valve is a first pressure relief valve located in a first cavity and uphole from the first ball valve member and further including a second pressure relief valve located within a second cavity formed in the interior diameter wall of the ball housing and downhole from the second ball valve member and wherein the fluid path extends from the fluid port to the first and second pressure relief valves.

Element 5: wherein the first and second pressure relief valves are set to divert a portion of the pressure exerted against the first or second ball valve member when in a closed position to a fluid located within the fluid chamber area through the fluid port.

Element 6: further comprising: a travel piston valve located within a cavity formed in an interior diameter wall of the ball housing and uphole or downhole from the fluid chamber area, the travel piston valve having a sealing member thereabout to provide a pressure seal about the travel piston valve; a travel piston valve communication port located in the ball housing that fluidly connects the travel piston valve with the central bore; and a fluid port having a first end that opens into the central bore of the ball housing and a second end that opens into a fluid path that extends from the port to the travel piston valve.

Element 7: wherein the travel piston valve is an assembly that further includes a biasing member located within the cavity that has a biasing constant that allows the biasing member to be compressed when a predetermined pressure is exerted against the travel piston valve.

Element 8: wherein the travel piston valve is a first travel piston valve located in a first cavity and uphole of the first ball valve member and further including a second travel piston valve located within a second cavity formed in the interior diameter wall of the ball housing and downhole of the second ball valve member and wherein the fluid path extends from the travel piston valve port to the first and second travel piston valves.

Element 9: wherein the first and second travel piston valves are first and second travel piston valve assemblies that each includes a biasing member located within the first and second cavities and that has a biasing constant that allows the biasing member to be compressed when a predetermined pressure is exerted against the first or second travel piston valves, respectively.

Element 10: wherein the first and second ball cages are slidable within each cavity of the first and second ball cages, and further comprising: a first biasing member located between a wall of the cavity in which the first ball cage is located and the first ball cage and engaged against the first ball cage; and a second biasing member located between a wall of the cavity in which the second ball cage is located and the second ball cage and engaged against the second ball cage.

Element 11: wherein the first and second ball cages are axially fixed with respect to each other and further comprising a pressure relief valve located within an interior diameter wall of the ball housing and positioned uphole or downhole from the fluid chamber area; a pressure communication port located in the ball housing that fluidly connects the pressure relief valve with the central bore; and a fluid port that has a first end that opens into the fluid chamber area of the ball housing and a second end that opens into a fluid path that extends from the fluid port to the pressure relief valve.

Element 12: wherein the pressure relief valve is set to divert a portion of the pressure exerted against the first or second ball valve member when in a closed position to a fluid located within the fluid chamber area through the fluid port.

Element 13: wherein the pressure relief valve is a first pressure relief valve located in a first cavity and uphole from the first ball valve member and further including a second pressure relief valve located within a second cavity formed in the interior diameter wall of the ball housing and downhole from the second ball valve member and wherein the fluid path extends from the fluid port to the first and second pressure relief valves.

Element 14: wherein the first and second pressure relief valves are set to divert a portion of the pressure exerted against the first or second ball valve members when closed positions to a fluid located within the fluid chamber area through the fluid port.

Element 15: further comprising: a travel piston valve located within a cavity formed in an interior diameter wall of the ball housing and uphole or downhole from the fluid chamber area, the travel piston valve having a sealing member thereabout to provide a pressure seal about the travel piston valve; a travel piston valve communication port located in the ball housing that fluidly connects the pressure travel piston valve with the central bore; and a fluid port having a first end that opens into the central bore of the ball housing and a second end that opens into a fluid path that extends from the port to the travel piston valve.

Element 16: wherein the travel piston valve is an assembly that further includes a biasing member located within the cavity that has a biasing constant designed to allow the biasing member to be compressed when a predetermined pressure is exerted against the travel piston valve.

Element 17: wherein the travel piston valve is a first travel piston valve located in a first cavity and uphole of the first ball valve member and further including a second travel piston valve located within a second cavity formed in the interior diameter wall of the ball housing and downhole of the second ball valve member and wherein the fluid path extends from the travel piston valve port to the first and second travel piston valves.

Element 18: wherein the first and second travel piston valves are first and second travel piston valve assemblies that each includes a biasing member located within the first and second cavities and that has a biasing constant that allows the biasing member to be compressed when a predetermined pressure is exerted against the first or second travel piston valves, respectively.

Those skilled in the art to which this application relates will appreciate that other and further additions, deletions, substitutions and modifications may be made to the described embodiments.

What is claimed is:

1. A valve assembly, comprising:

a valve body having a ball housing with a central bore there through;

first and second ball cages each located within respective cavities formed in the ball housing, wherein the first and second ball cages are slidable within their respective cavities;

first and second ball valve members located within and rotatably coupled to the first and second ball cages, respectively, and each having a bore there through and located in the ball housing for selective rotation between open and closed positions to control flow through the valve assembly, the first and second ball valve members defining a fluid chamber area located within the central bore and between the first and second ball valve members;

one or more control arms coupled to the first and second ball valve members, the one or more control arms actionable on the first and second ball valve members to rotate the first and second ball valve members to the open or closed positions;

a first seating member located between the first and second ball valve members and being slidably coupled to the valve body adjacent the central bore and having a metal seat located on a seating end thereof that is engagable against the first ball valve member; and a second seating member located downhole from the second ball valve member and engagable against the second ball valve member and having a metal seat located on a seating end thereof that is engagable against the second ball valve member.

2. The valve assembly as recited in claim 1, wherein the first and second ball cages further comprise:

a first biasing member located between a first wall of a first of the respective cavities in which the first ball cage is located and the first ball cage and engaged against the first ball cage; and a second biasing member located between a second wall of a second of the respective cavities in which the second ball cage is located and the second ball cage and engaged against the second ball cage.

3. The valve assembly as recited in claim 1, further comprising:

a travel piston valve located within of the ball housing and uphole or downhole from the fluid chamber area, the travel piston valve having a sealing member thereabout to provide a pressure seal about the travel piston valve;

a travel piston valve communication port located in the ball housing that fluidly connects the travel piston valve with the central bore; and a fluid port having a first end that opens into the central bore of the ball housing and a second end that opens into a fluid path that extends from the port to the travel piston valve.

4. The valve assembly as recited in claim 3, wherein the travel piston valve is an assembly that further includes a biasing member located within the ball housing that has a biasing constant that allows the biasing member to be compressed when a predetermined pressure is exerted against the travel piston valve.

5. The valve assembly as recited in claim 3, wherein the travel piston valve is a first travel piston valve located in a first travel piston cavity and uphole of the first ball valve member and further including a second travel piston valve located within a second travel piston cavity formed in the ball housing and downhole of the second ball valve member and wherein the fluid path extends from the travel piston valve port to the first and second travel piston valves.

6. The valve assembly as recited in claim 5, wherein the first and second travel piston valves are first and second travel piston valve assemblies that each includes a biasing member located within the first and second travel piston cavities and that has a biasing constant that allows the biasing member to be compressed when a predetermined pressure is exerted against the first or second travel piston valves, respectively.

7. A well system, comprising:

a string of tubing extending into a wellbore and connected to a valve assembly and being supported from a rig support structure, the valve assembly comprising:

a valve body having a ball housing with a central bore there through;

first and second ball cages each located within respective cavities formed in the ball housing, wherein the first and second ball cages are slidable within respective cavities;

first and second ball valve members located within and rotatably coupled to the first and second ball cages, respectively, and each having a bore there through and located in the ball housing for selective rotation between open and closed positions to control flow through the valve assembly, the first and second ball valve members defining a fluid chamber area located within the central bore and between the first and second ball valve members;

one or more control arms coupled to the first and second ball valve members, the one or more control arms actionable on the first and second ball valve members to rotate the first and second ball valve members to the open or closed positions;

a first seating member located between the first and second ball valve members and being slidably coupled to the valve body adjacent the central bore and having a metal seat located on a seating end thereof that is engagable against the first ball valve member;

a second seating member located downhole from the second ball valve member and engagable against the second ball valve member and having a metal seat located on a seating end thereof that is engagable against the second ball valve member.

8. The valve assembly as recited in claim 7, wherein the first and second ball cages further comprise:

a first biasing member located between a first wall of a first of the respective cavities in which the first ball cage is located and the first ball cage and engaged against the first ball cage; and a second biasing member located between a second wall of a second of the respective cavities in which the second ball cage is located and the second ball cage and engaged against the second ball cage.

9. The valve assembly as recited in claim 7, further comprising:

a travel piston valve located within the ball housing and uphole or downhole from the fluid chamber area, the travel piston valve having a sealing member thereabout to provide a pressure seal about the travel piston valve;

a travel piston valve communication port located in the ball housing that fluidly connects the pressure travel piston valve with the central bore; and a fluid port having a first end that opens into the central bore of the ball housing and a second end that opens into a fluid path that extends from the port to the travel piston valve.

10. The valve assembly as recited in claim 9, wherein the travel piston valve is an assembly that further includes a biasing member located within the ball housing that has a biasing constant that allows the biasing member to be compressed when a predetermined pressure is exerted against the travel piston valve.

11. The valve assembly as recited in claim 9, wherein the travel piston valve is a first travel piston valve located in a first travel piston cavity and uphole of the first ball valve member and further including a second travel piston valve located within a second travel piston cavity formed in the ball housing and downhole of the second ball valve member and wherein the fluid path extends from the travel piston valve communication port to the first and second travel piston valves.

12. The valve assembly as recited in claim 11, wherein the first and second travel piston valves are first and second travel piston valve assemblies that each includes a biasing member located within the first and second travel piston cavities and that has a biasing constant that allows the biasing member to be compressed when a predetermined pressure is exerted against the first or second travel piston valves, respectively.

* * * * *